US008897665B2

(12) United States Patent
Kamimura

(10) Patent No.: US 8,897,665 B2
(45) Date of Patent: Nov. 25, 2014

(54) PHOTOSENSITIVE MEMBER UNIT HAVING ELECTRODE AND IMAGE FORMING APPARATUS USING THE SAME

(75) Inventor: Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 174 days.

(21) Appl. No.: 13/598,798

(22) Filed: Aug. 30, 2012

(65) Prior Publication Data

US 2013/0051834 A1 Feb. 28, 2013

(30) Foreign Application Priority Data

Aug. 31, 2011 (JP) ..... 2011-190036

(51) Int. Cl.
*G03G 15/00* (2006.01)
*G03G 21/18* (2006.01)

(52) U.S. Cl.
CPC ..... *G03G 15/757* (2013.01); *G03G 21/1803* (2013.01); *G03G 21/1867* (2013.01)
USPC ..... 399/90; 399/116; 399/343; 399/357

(58) Field of Classification Search
USPC ..... 399/90, 343, 357
See application file for complete search history.

(56) References Cited

U.S. PATENT DOCUMENTS 5,740,494 A * 4/1998 Shoji et al. ..... 399/71
2006/0269313 A1* 11/2006 Takagi ..... 399/90
2008/0175617 A1* 7/2008 Morishita ..... 399/99

FOREIGN PATENT DOCUMENTS

JP 2006-330620 A 12/2006

* cited by examiner

*Primary Examiner* — David Gray
*Assistant Examiner* — Michael Harrison
(74) *Attorney, Agent, or Firm* — Banner & Witcoff, Ltd.

(57) ABSTRACT

A photosensitive member unit includes a photosensitive member, first and second side walls, a rotatable body and a unit electrode. The photosensitive member defines an axis extending in an axial direction, and has first and second end portions in the axial direction. The first side wall rotatably supports the first end portion and the second side wall rotatably supports the second end portion. The rotatable body is rotatably disposed between the first and the second side walls. The rotatable body confronts and contacts the photosensitive member in a prescribed direction perpendicular to the axial direction to be movable in the prescribed direction. The unit electrode is provided at the first side wall and supports the rotatable body, the first side wall supporting the unit electrode to permit the unit electrode to be movable in the prescribed direction in conjunction with movement of the rotatable body in the axial direction.

20 Claims, 10 Drawing Sheets

62R(62)

PHOTOSENSITIVE MEMBER UNIT HAVING ELECTRODE AND IMAGE FORMING APPARATUS USING THE SAME

CROSS REFERENCE TO RELATED APPLICATION

This application claims priority from Japanese Patent Application No. 2011-190036 filed Aug. 31, 2011. The entire content of the priority application is incorporated herein by reference.

TECHNICAL FIELD

The present invention relates to a photosensitive member cartridge and an electro-photographic type image forming apparatus using the photosensitive member cartridge.

BACKGROUND

Well known is an electro-photographic type printer that detachably accommodates a process cartridge including a photosensitive member cartridge and a developing cartridge. The photosensitive member cartridge includes a photosensitive drum, and the developing cartridge includes a developing roller for supply toner to the photosensitive drum.

One of such conventional photosensitive member cartridges mountable in such electro-photographic type printer includes a photosensitive drum, a scorotron charger disposed upward of the photosensitive drum to oppose the same, a transfer roller disposed downward of the photosensitive drum, and a cleaning brush disposed rearward of the photosensitive drum.

This photosensitive member cartridge includes a drum casing on which an electrode member is provided for applying bias to the transfer roller. The electrode member is configured to be in contact with a resilient power feeding member disposed in a main casing of the printer. The electrode member is disposed on the drum casing such that the electrode member is in abutment with an end surface of a roller shaft of the transfer roller in a lateral direction.

The transfer roller is supported to the drum casing so as to be movable relative to the same. The transfer roller is prevented from moving upward due to its contact with the photosensitive drum. Further, the transfer roller is biased toward another end surface opposite to the end surface in the lateral direction, together with the electrode member, due to a resilient force of the power feeding member. The transfer roller is thus positioned in the lateral direction.

SUMMARY

In the above-described photosensitive member cartridge, while the transfer roller is permitted to move relative to the drum casing, the electrode member is fixedly engaged with the drum casing. As a result, when the transfer roller is caused to move slightly upward or downward following rotation of the photosensitive drum, the end face of the roller shaft of the transfer roller may slidingly contact relative to the electrode member, possibly causing attrition of both of the end face of the roller shaft and the electrode member.

Such attrition of the end face of the roller shaft and the electrode member may lead to unstable physical contact of the end face of the roller shaft with the electrode member, thereby rendering electrical connection therebetween unstable. Therefore, stable application of bias to the transfer roller becomes difficult to be achieved.

In view of the foregoing, it is an object of the present invention to provide a photosensitive member cartridge capable of stably supplying power to a rotatable body supported to the photosensitive member cartridge, and an image forming apparatus provided with the photosensitive member cartridge.

According to an aspect of the present invention, there is provided a photosensitive member unit including a photosensitive member, a first side wall, a second side wall, a rotatable body and a unit electrode. The photosensitive member defines an axis extending in an axial direction and configured to rotate about the axis, the photosensitive member having a first end portion and a second end portion opposite to the first end portion in the axial direction. The first side wall is configured to rotatably support the first end portion of the photosensitive member, and the second side wall is disposed in opposition to the first side wall in the axial direction and configured to rotatably support the second end portion of the photosensitive member. The rotatable body extends in the axial direction and is rotatably disposed between the first side wall and the second side wall, the rotatable body being in confrontation with and in contact with the photosensitive member in a prescribed direction perpendicular to the axial direction, the rotatable body being movable in the prescribed direction. The unit electrode is provided at the first side wall, and supports and is in contact with the rotatable body for supplying electricity to the rotatable body, the first side wall supporting the unit electrode such that the unit electrode is movable in the prescribed direction in conjunction with movement of the rotatable body in the prescribed direction.

According to another aspect of the present invention, there is provided an image forming apparatus including a main casing, a photosensitive member unit and a main-body electrode. The photosensitive member unit includes a photosensitive member, a first side wall, a second side wall, a rotatable body and a unit electrode. The photosensitive member defines an axis extending in an axial direction and configured to rotate about the axis, the photosensitive member having a first end portion and a second end portion opposite to the first end portion in the axial direction. The first side wall is configured to rotatably support the first end portion of the photosensitive member, and the second side wall is disposed in opposition to the first side wall in the axial direction and configured to rotatably support the second end portion of the photosensitive member. The rotatable body extends in the axial direction and is rotatably disposed between the first side wall and the second side wall, the rotatable body being in confrontation with and in contact with the photosensitive member in a prescribed direction perpendicular to the axial direction, the rotatable body being movable in the prescribed direction. The unit electrode is provided at the first side wall and in contact with the rotatable body for supplying electricity to the rotatable body, the first side wall supporting the unit electrode such that the unit electrode is movable in the prescribed direction in conjunction with movement of the rotatable body in the prescribed direction. The main-body electrode is disposed within the main casing for supplying electricity to the unit electrode.

According to still another aspect of the present invention, there is provided a photosensitive member unit including a photosensitive member, a side wall, a rotatable body and a unit electrode. The photosensitive member defines an axis extending in an axial direction and configured to rotate about the axis, the photosensitive member having an end portion. The side wall is configured to rotatably support the end portion of the photosensitive member. The rotatable body extends in the axial direction, the rotatable body being in confrontation with and in contact with the photosensitive member in a prescribed direction perpendicular to the axial direction, the rotatable body being movable in the prescribed direction. The unit electrode is provided at the side wall, and supports and is in contact with the rotatable body for supplying electricity to the rotatable body, the side wall supporting the unit electrode such that the unit electrode is movable in the prescribed direction in conjunction with movement of the rotatable body in the prescribed direction.

With this construction, the unit electrode is permitted to move in the prescribed direction perpendicular to the axial direction, following movement of the rotational body in the prescribed direction. Hence, attrition between the unit electrode and the rotational body can be suppressed, thereby realizing stable power supply to the rotatable body via the unit electrode.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
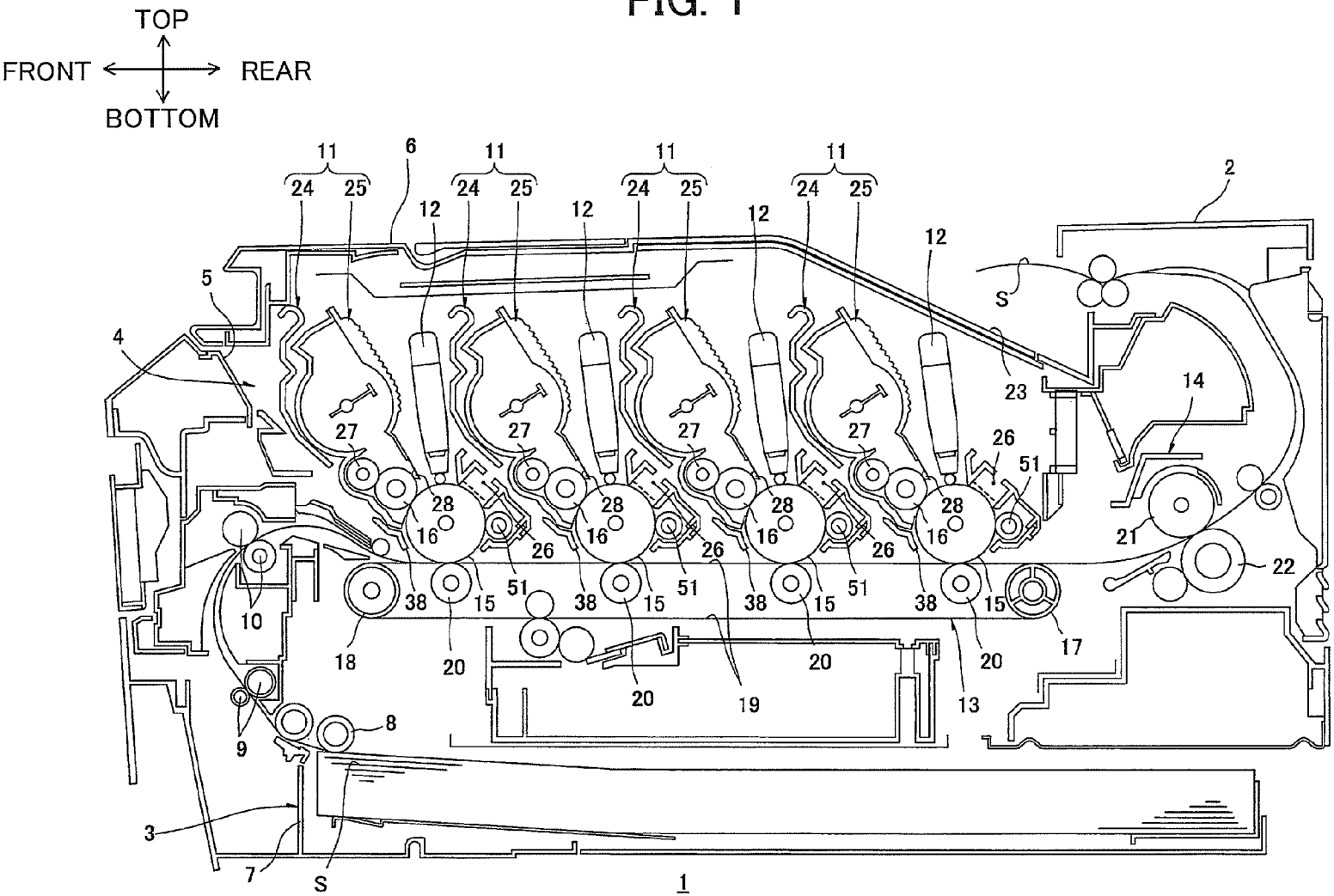
FIG. 1 is a cross-sectional view of a color printer as an image forming device according to one embodiment of the present invention, the color printer including a plurality of drum cartridges each having a photosensitive drum.

A printer 1 as an image forming device according to one embodiment of the present invention will be described while referring to FIGS. 1 to 10B wherein like parts and components are designated by the same reference numerals to avoid duplicating description.

1. Overall Structure of Color Printer

As shown in FIG. 1, the printer 1 is a horizontal direct tandem type color printer 1.

Throughout the specification, the terms "upward", "downward", "upper", "lower", "above", "below", "beneath", "right", "left", "front", "rear" and the like will be used assuming that the printer 1 is disposed in an orientation in which it is intended to be used. Specifically, in FIG. 1, the left side is a front side, and a right side is a rear side of the printer 1. Further, "right side" and "left side" will be used when viewing the printer from its front side. In other words, the near side in FIG. 1 is a right side, and the far side in FIG. 1 is a left side of the printer 1.

Referring to FIG. 1, the printer 1 includes a main casing 2 having a generally box shape. The main casing 2 has an upper end portion on which a main-body opening 5 is formed. A top cover 6 is provided on the upper end portion of the main casing 2 such that the top cover 6 is pivotally movable about its rear end portion for closing and opening the main-body opening 5.

In the main casing 2, a sheet feeding unit 3 for feeding sheets S and an image forming unit 4 for forming images on the sheets S fed thereto are provided.

The sheet feeding unit 3 is detachably provided at a bottom portion of the main casing 2. The sheet feeding unit 3 includes a sheet tray 7 for accommodating the sheets S in a stacked state. A pick-up roller 8 and a pair of feeding rollers 9 are disposed upward of a front end portion of the sheet tray 7. A pair of registration rollers 10 is also disposed upward of the pair of feeding rollers 9.

The sheets S accommodated in the sheet tray 7 are fed one by one toward the pair of registration rollers 10 by rotation of the pick-up roller 8 and the feeding rollers 9, and then conveyed toward the image forming unit 4 at prescribed timings.

The image forming unit 4 includes four process cartridges 11 corresponding to four colors of toner (black, yellow, magenta and cyan), four LED units 12, a transfer unit 13, and a fixing unit 14.

Process cartridges 11 are detachably mountable in the main casing 2 through the main-body opening 5 when the top cover 6 is opened. When mounted in the main casing 2, the process cartridges 11 are juxtaposedly arrayed in a front-to-rear direction with a space between neighboring cartridges. Each process cartridge 11 includes a drum cartridge 24 (as an example of a claimed photosensitive member unit) and a developing cartridge 25 detachable from and attachable to the drum cartridge 24.

Each drum cartridge 24 includes a photosensitive drum 15 and a scorotron charger 26. The photosensitive drum 15 has a cylindrical shape extending in an axial direction, which is coincident with a left-to-right direction (lateral direction) of the printer 1. The photosensitive drum 15 is rotatably supported to a drum frame 31 (described later) of the drum cartridge 24.

The scorotron charger 26 is disposed upward and rearward of the photosensitive drum 15 so as to oppose the same with a prescribed distance therebetween.

The developing cartridge 25 includes a developing roller 16, a supply roller 27 and a thickness-regulating blade 28.

The developing roller 16 is provided at a rear end portion of a casing of the developing cartridge 25 such that the developing roller 16 is exposed rearward from the rear end portion of the casing of the developing cartridge 25. The developing roller 16 is positioned upward and rearward of the photosensitive drum 15 so as to be in contact with the same.

The supply roller 27 serves to supply toner to the photosensitive drum 15, and the thickness-regulating blade 28 serves to regulate a thickness of a toner layer formed on the developing roller 16. A toner container (shown without a reference numeral) is positioned above the supply roller 27 and the thickness-regulating blade 28 for containing a toner as a developing agent.

Each LED unit 12 is disposed upward and rearward of each process cartridge 11 such that the LED unit 12 confronts the corresponding photosensitive drum 15 from above. Each LED unit 12 exposes a peripheral surface of the corresponding photosensitive drum 15 to light based on a predetermined image data to form an electrostatic latent image on the surface.

The transfer unit 13 is disposed upward of the sheet feeding unit 3 and downward of the respective process cartridges 11. The transfer unit 13 extend's in the front-to-rear direction.

Specifically, the transfer unit 13 includes a drive roller 17, a follower roller 18 disposed in opposition to and in separation from the drive roller 17 in the front-to-rear direction, and an endless conveyor belt 19 mounted on the drive roller 17 and the follower roller 18 under tension.

The conveyor belt 19 has an upper portion that is in contact with each of the photosensitive drums 15. The conveyor belt 19 is circularly moved as the drive roller 17 rotates such that the upper portion of the conveyor belt 19 moves from the front side toward the rear side of the printer 1.

The transfer unit 13 also includes four transfer rollers 20. Each transfer roller 20 is disposed in opposition to each photosensitive drum 15 via the upper portion of the conveyor belt 19.

The fixing unit 14 is disposed rearward of the transfer unit 13. The fixing unit 14 includes a heat roller 21 for applying heat and a pressure roller 22 in pressure contact with the heat roller 21.

Toner stored in the toner container of the developing cartridge 25 is supplied to the supply roller 27, and then to the developing roller 16. The toner is triboelectrically charged with positive polarity between the supply roller 27 and the developing roller 16. The toner supplied to the developing roller 16 is regulated to have a uniform thickness by the thickness-regulating blade 28 as the developing roller 16 rotates, and is carried on a peripheral surface of the developing roller 16 in a form of a thin layer having a constant thickness.

On the other hand, the peripheral surface of each photosensitive drum 15 is uniformly charged by the scorotron charger 26, and is then exposed to light by the corresponding LED unit 12, thereby forming an electrostatic latent image on the surface based on the predetermined image data. When the toner carried on the surface of the developing roller 16 is supplied to the electrostatic latent image, a visible toner image corresponding to the electrostatic latent image is formed on the peripheral surface of the photosensitive drum 15.

The sheet S fed from the sheet feeding unit 3 is conveyed rearward by the conveyor belt 19. As each sheet S on the conveyor belt 19 passes between each photosensitive drum 15 and its corresponding transfer roller 20 (transfer position), toner image of each color is successively transferred onto the sheet S to provide a color image thereon.

The color image transferred onto the sheet S is then thermally fixed thereon as the sheet S passes between the heat roller 21 and the pressure roller 22. The sheet S is then conveyed along a generally U-shaped passage extending first rearward and upward and then frontward and upward. The sheet S is finally discharged onto a discharge tray 23 formed on the top cover 6.

2. Structure of Drum Cartridge (1) Drum Frame

Figure 2:
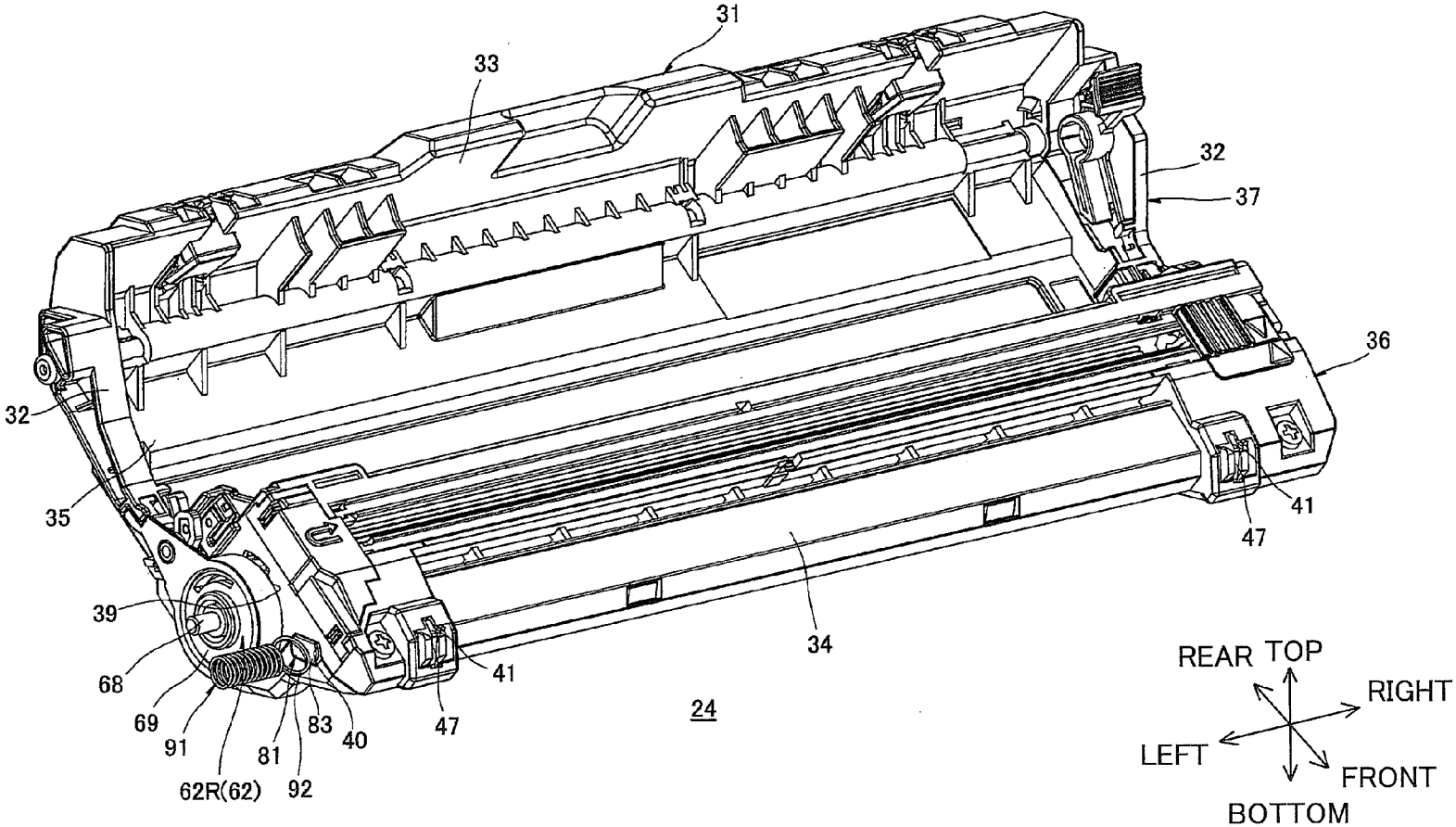
FIG. 2 is a perspective view of the drum cartridge of FIG. 1 as viewed from upward and rearward thereof, the drum cartridge including a cartridge electrode.
Figure 3:
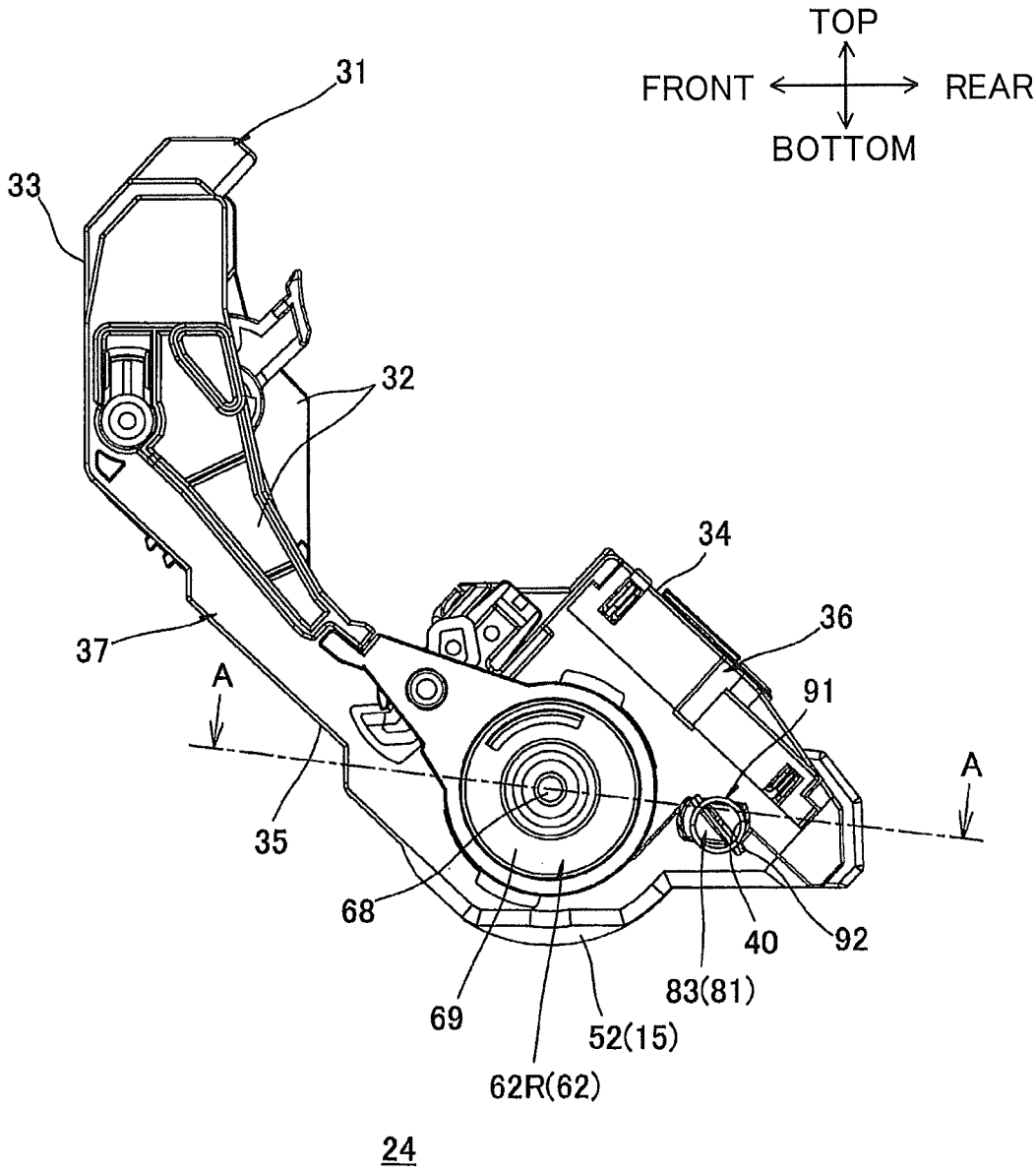
FIG. 3 is a right side view of the drum cartridge of FIG. 2.

As shown in FIGS. 2 and 3, the drum cartridge 24 includes the drum frame 31 having a generally rectangular frame-like shape whose bottom end is closed.

Specifically, the drum frame 31 includes a pair of side walls 32 (left and right side walls 32), a front wall 33 connecting between front end portions of respective side walls 32, a top wall 34 connecting between upper-rear end portions of both side walls 32, and a bottom wall 35 connecting lower portions of the both side walls 32. Among the pair of side walls, the side wall 32 positioned on the right side corresponds to a claimed third side wall, and the side wall 32 positioned on the left side corresponds to a claimed fourth side wall. The bottom wall 35 corresponds to a claimed fifth side wall.

The side wall 32 has a generally rectangular shape in a side view extending generally in the front-to-rear direction (more specifically, in a direction parallel to a line connecting between the lower-rear side to the upper-front side). On each side wall 32, a drum shaft bearing supporting hole 39 is formed. On the right side wall 32, an electrode exposing hole 40 is also formed.

The drum shaft bearing supporting hole 39 is formed at a lower-rear end portion of each side wall 32. The drum shaft bearing supporting hole 39 has a generally circular side view and penetrates through the corresponding side wall 32 in the lateral direction. Each drum shaft bearing supporting hole 39 is adapted to receive one of drum shaft bearing members 62 (described later) supporting both lateral end portions of the photosensitive drum 15.

The electrode exposing hole 40 is formed on a rear end portion of the right side wall 32 at a position rearward of the drum shaft bearing supporting hole 39 (see FIG. 2). The electrode exposing hole 40 has a generally rectangular shape in a side view elongated in the front-to-rear direction. The electrode exposing hole 40 is adapted to hold a cartridge electrode 81 (described later) provided at a right axial end portion of a roller shaft 56 of a cleaning roller 51 (described later).

The front wall 33 is generally flat plate-like shaped, extending the lateral direction.

The top wall 34 has a generally flat plate-like shape extending in the lateral direction. The top wall 34 covers the photosensitive drum 15 from above. The scorotron charger 26 is supported to a lower surface of the top wall 34.

The bottom wall 35 extends rearward from a lower end portion of the front wall 33 and is generally flat plate-like shaped. The bottom wall 35 has a generally U-shape in a side view which is open upward. The bottom wall 35 has a rear end portion on which a drum exposing opening 38 (see FIG. 1) is formed to penetrate therethrough. The drum exposing opening 38 is elongated in the lateral direction to expose the photosensitive drum 15 downward therefrom.

Figure 4:
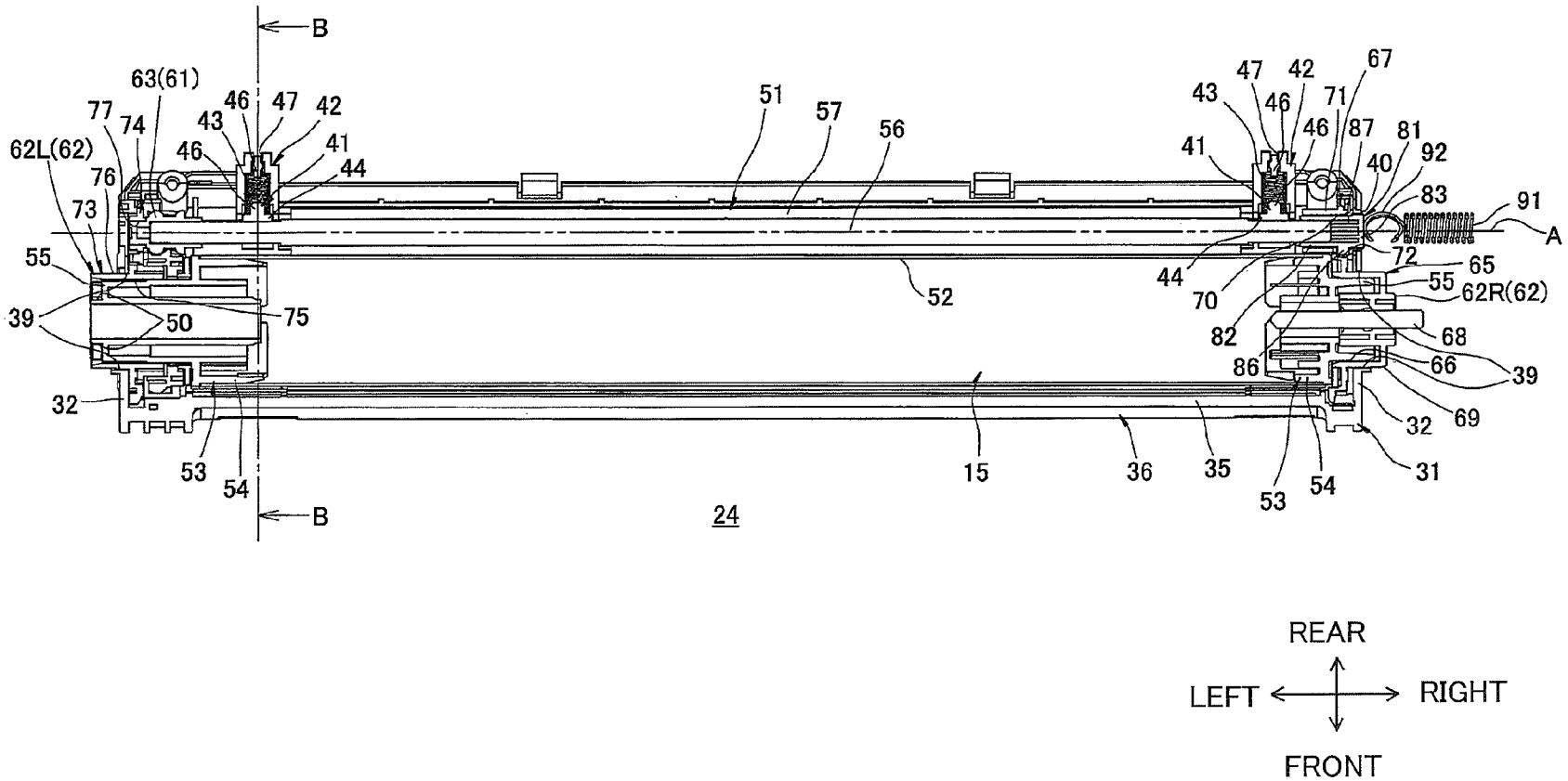
FIG. 4 is a cross-sectional view of the drum cartridge taken along a line A-A shown in FIG. 3.
Figure 6:
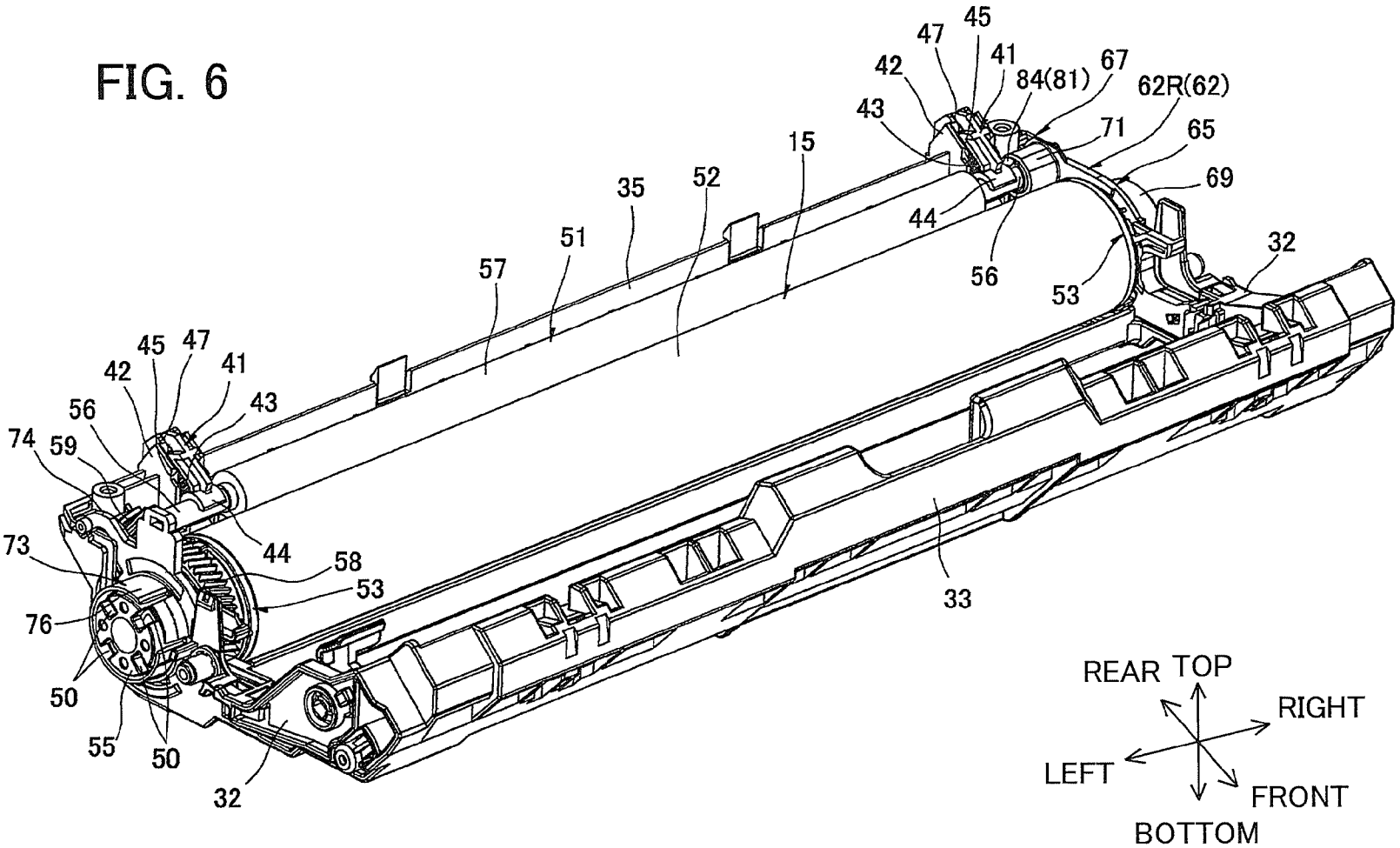
FIG. 6 is a perspective view of the drum cartridge of FIG. 2 when viewed from upward and frontward thereof, wherein an upper wall of the drum cartridge is removed.

The bottom wall 35 has a rear end portion on which a pair of pressing member accommodating portions 42 is provided, as shown in FIGS. 4 and 6. Each pressing member accommodating portion 42 is disposed at each lateral end portion of the rear end portion of the bottom wall 35. More specifically, each pressing member accommodating portion 42 is formed at a position outward of and adjacent to each lateral end portion of a roller main body 57 (described later) of the cleaning roller 51 in the lateral direction. Each pressing member accommodating portion 42 has a generally rectangular frame-like shape elongated in the front-to-rear direction. Each pressing member accommodating portion 42 has a rear wall on which a coupling groove 47 is formed at a position generally center thereof in the lateral direction. The coupling groove 47 penetrates through the rear wall in the front-to-rear direction. Each pressing member accommodating portion 42 accommodates therein a pressing member 41 (described later) such that a rear end portion of the pressing member 41 is coupled to the coupling groove 47.

As shown in FIG. 2, in the drum frame 31, a drum accommodating portion 36 for accommodating the photosensitive drum 15 therein is defined by a rear-half portion of the bottom wall 35, the right and left side walls 32 corresponding to the rear-half portion of the bottom wall 35, and the top wall 34 corresponding to the rear-half portion of the bottom wall 35.

Further, in the drum frame 31, a developing cartridge accommodating portion 37 for accommodating the developing cartridge 25 therein is also defined by a front-half portion of the bottom wall 35, the right and left side walls 32 corresponding to the front-half portion of the bottom wall 35, the front wall 33 corresponding to the front-half portion of the bottom wall 35, and a peripheral front edge of the top wall 34.

(2) Photosensitive Drum and Cleaning Roller

Within the drum accommodating portion 36, the photosensitive drum 15 and the cleaning roller 51 (as an example of a claimed rotatable body) are disposed, as shown in FIGS. 4 and 6.

The photosensitive drum 15 includes a base cylinder 52 and a pair of flange members 53 each provided at each lateral end portion of the base cylinder 52.

Figure 7:
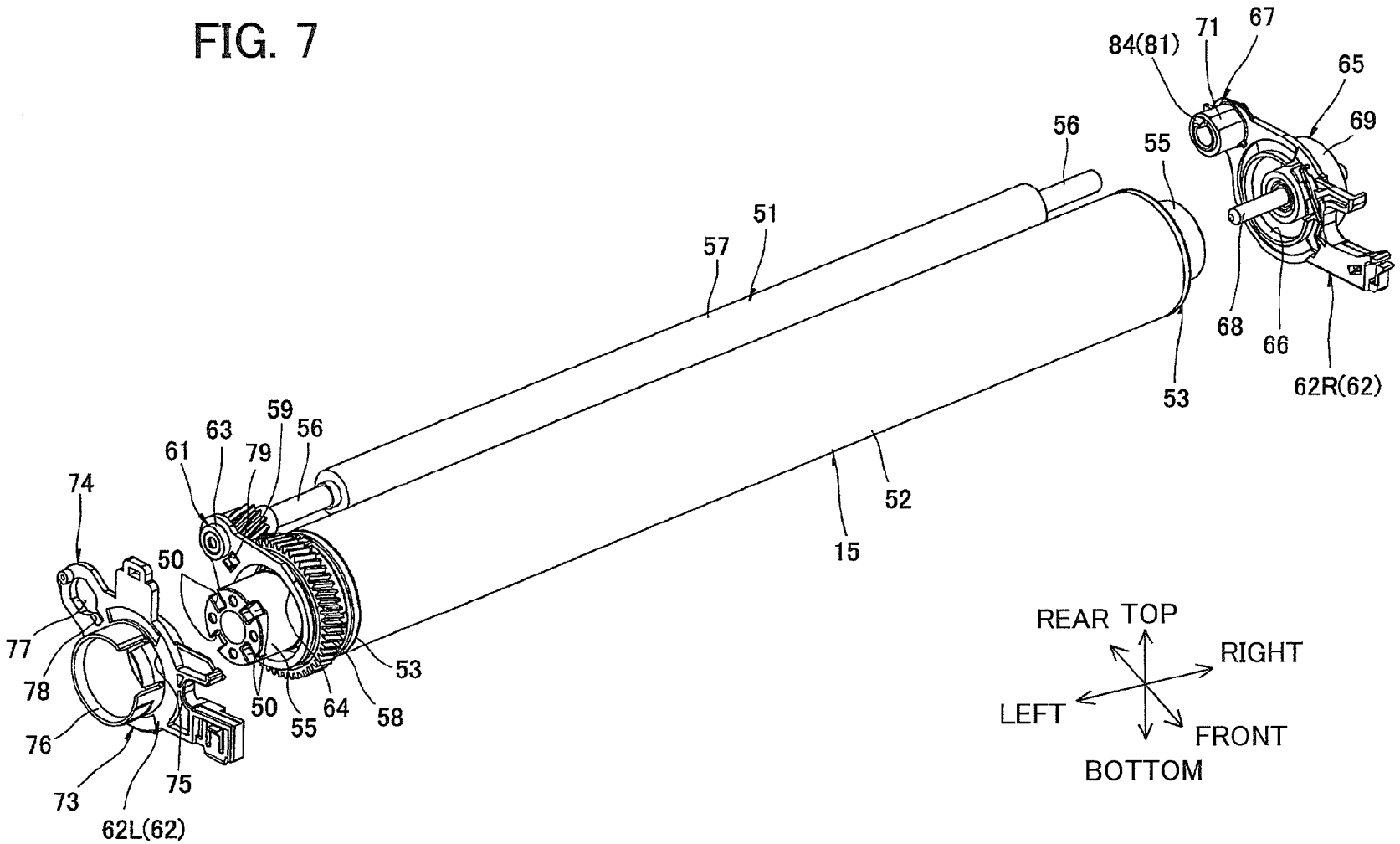
FIG. 7 is a view showing a cleaning shaft bearing member and a pair of drum shaft bearing members (left and right drum shaft bearing members) assembled to the photosensitive drum.

Referring to FIG. 7, the base cylinder 52 is made of a metal, and has a generally cylindrical shape extending in the lateral direction. The base cylinder 52 has an outer circumferential surface which is coated with a photosensitive layer.

Each flange member 53 is made from a resin. Each flange portion 53 integrally includes a base-cylinder coupled portion 54 and a bearing coupled portion 55.

Each base-cylinder coupled portion 54 is coupled to (inserted into an internal space of) each lateral end portion of the base cylinder 52 such that the base-cylinder coupled portion 54 is incapable of rotating relative to the base cylinder 52.

Each base-cylinder coupled portion 54 has a diametrically central portion on which the bearing coupled portion 55 is formed. Specifically, the bearing coupled portion 55 is formed in a generally columnar shape, protruding laterally outward from an outer surface of the central portion of each base-cylinder coupled portion 54. In other words, each bearing coupled portion 55 and each base-cylinder coupled portion 54 are coaxially positioned relative to each other. The bearing coupled portion 55 is rotatably supported by the drum shaft bearing supporting hole 39 of the drum frame 31 via the corresponding drum shaft bearing member 62 (described later).

On the bearing coupled portion 55 coupled to the left end portion of the base cylinder 52 (will be referred to as "left bearing coupled portion 55"), four coupling grooves 50 are formed. Specifically, the coupling grooves 50 are formed on a left end portion of the bearing coupled portion 55. The coupling grooves 50 are spaced away from one another at equi-intervals along a circumference of the left end portion of the bearing coupled portion 55 such that the coupling grooves 50 are positionally displaced by about 90 degrees relative to one another. These coupling grooves 50 are adapted to be coupled to coupling protrusions (not shown) of a coupling member (not shown) disposed in the main casing 2 so as to receive a driving force transmitted from a driving source (not shown) disposed in the main casing 2 when the process cartridge 11 is mounted in the main casing 2.

Further, as shown in FIG. 7, a transmission gear 58 is provided on the left bearing coupled portion 55 at a rightmost position thereof such that the transmission gear 58 is incapable of rotating relative to the bearing coupled portion 55.

The cleaning roller 51 is disposed rearward of the photosensitive drum 15 to be in contact with the same. The cleaning roller 51 extends in the axial direction parallel to the lateral direction, and includes the roller shaft 56 and the roller main body 57 provided around the roller shaft 56.

The roller shaft 56 is made from a metal and extends in the axial direction. The roller shaft 56 defines an axis A extending the axial direction about which the cleaning roller 51 is rotatable (see FIG. 9A). The roller shaft 56 has a left axial end portion on which a cleaning roller drive gear 59 is provided so as not to rotate relative to the roller shaft 56. The cleaning roller drive gear 59 meshingly engages the transmission gear 58 of the left flange member 53.

The roller main body 57 is made from a sponge material. The roller main body 57 is generally cylindrical shaped, extending in the axial direction. The roller main body 57 is provided around the roller shaft 56 such that the roller main body 57 covers a center portion of the roller shaft 56 but both axial end portions of the roller shaft 56 are exposed (not covered by the roller main body 57).

(3) Pressing Members

Figure 5:
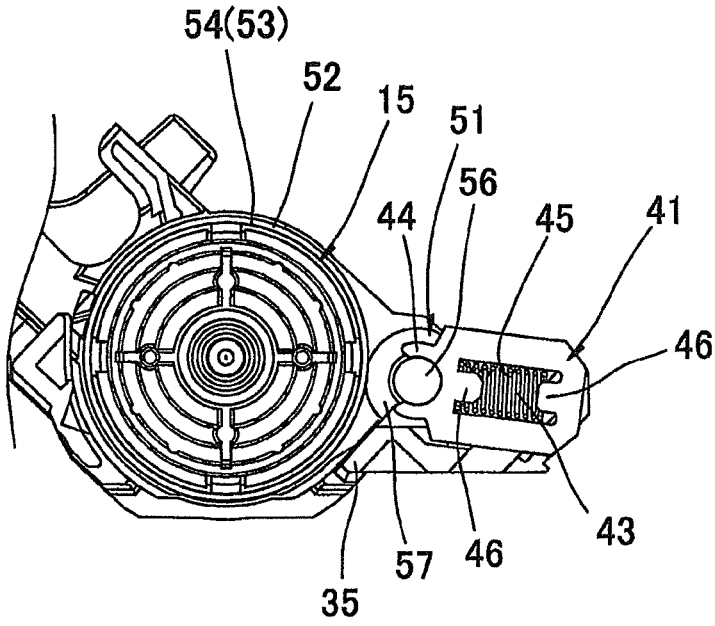
FIG. 5 is a cross-sectional view of the drum cartridge of FIG. 4 taken along a line B-B shown in FIG. 4.
Figure 5:
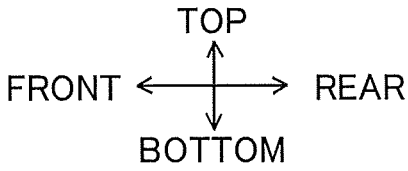

The drum cartridge 24 includes a pair of pressing members 41 (as an example of a claimed pressing portion) for pressing the cleaning roller 51 toward the photosensitive drum 15, as shown in FIGS. 4, 5 and 6. As described, each pressing member 41 is accommodated within each pressing member accommodating portion 42 formed on the bottom wall 35 of the drum frame 31.

Referring to FIG. 5, the pressing member 41 is formed in a flat plate-like shape having a generally rectangular-shaped side view extending in the front-to-rear direction. Each pressing member 41 is formed with a spring supporting hole 45 and a shaft abutment portion 44.

The spring supporting hole 45 has a generally rectangular shape in a side view elongated in the front-to-rear direction, and is formed at a position substantially center of the pressing member 41 in a top-to-bottom direction. The spring supporting hole 45 penetrates through the pressing member 41 in the lateral direction. A pair of spring supporting bosses 46 is formed on the spring supporting hole 45 to oppose each other in the front-to-rear direction.

Specifically, each spring supporting boss 46 has a generally columnar shape protruding from an inner peripheral surface of the spring supporting hole 45 toward a center of the spring supporting hole 45 in the front-to-rear direction. More specifically, one of the spring supporting bosses 46 protrudes rearward from an inner peripheral surface of a front end portion of the spring supporting hole 45, while remaining one of the spring supporting bosses 46 protrudes frontward from an inner peripheral surface of a rear end portion of the spring supporting hole 45.

A compression spring 43 is accommodated within each spring supporting hole 45 such that compression spring 43 has one end coupled to the spring supporting boss 46 on the front side and another end coupled to the other spring supporting boss 46 on the rear side. As shown in FIG. 4, both lateral end portions of the compression spring 43 are exposed (and protrude) outward of the spring supporting hole 45 in the lateral direction.

The shaft abutment portion 44 is provided at a front end portion of each pressing member 41. As shown in FIGS. 4 and 6, the shaft abutment portion 44 extends in the lateral direction and is formed in a generally C-shape in a side view which is open frontward. The shaft abutment portion 44 has an inner diameter substantially identical to (slightly larger than) an outer diameter of the roller shaft 56 of the cleaning roller 51.

Each pressing member 41 is accommodated within the corresponding pressing member accommodating portion 42 such that the rear end portion of the pressing member 41 is movably coupled to the coupling groove 47. In this state, both lateral end portions of the rear end portion of each compression spring 43 (the lateral end portions projecting laterally outward from the spring supporting hole 45) is in abutment with an inner surface (front surface) of a peripheral edge of the corresponding coupling groove 47 formed on the rear wall of the pressing member accommodating portion 42.

The compression spring 43 is thus disposed in a compressed state between the rear wall of the pressing member accommodating portion 42 and the shaft abutment portion 44 in the front-to-rear direction. With this structure, the pressing member 41 is normally biased frontward due to a biasing force of the compression spring 43.

(4) Cleaning Shaft Bearing Member and Drum Shaft Bearing Member

Within the drum accommodating portion 36, a cleaning shaft bearing member 61 and the pair of drum shaft bearing members 62 are disposed.

The cleaning shaft bearing member 61 functions to support the left axial end portion of the roller shaft 56 of the cleaning roller 51. As shown in FIG. 7, the cleaning shaft bearing member 61 is flat plate-like shaped, having a droplet-like shaped side view. Specifically, the cleaning shaft bearing member 61 has a rear end portion whose width becomes narrower as extending rearward. The cleaning shaft bearing member 61 is formed with a cleaning shaft receiving portion 63, an engaging boss 79 and a flange penetrating hole 64.

The cleaning shaft receiving portion 63 is formed on the rear end portion of the cleaning shaft bearing member 61. The cleaning shaft receiving portion 63 has a generally cylindrical shape and protrudes leftward from a left surface of the rear end portion of the cleaning shaft bearing member 61 to penetrate therethrough in the lateral direction. The cleaning shaft receiving portion 63 has an inner diameter substantially identical to the outer diameter of the roller shaft 56.

The engaging boss 79 is positioned frontward of the cleaning shaft receiving portion 63. The engaging boss 79 has a generally rectangular columnar shape to protrude leftward from a left surface of the cleaning shaft bearing member 61.

The flange penetrating hole 64 is formed on a front portion of the cleaning shaft bearing member 61 at a position frontward of the engaging boss 79. The flange penetrating hole 64 is formed in an oblong shape elongated in the front-to-rear direction in a side view, and penetrates through the front portion of the cleaning shaft bearing member 61 in the lateral direction. The flange penetrating hole 64 has an inner diameter greater than an outer diameter of the bearing coupled portion 55.

The drum shaft bearing members 62 serve to support the flange members 53 of the photosensitive drum 15. The pair of drum shaft bearing members 62 is configured of a left drum shaft bearing member 62L (as an example of a claimed second side wall) and a right drum shaft bearing member 62R (as an example of a claimed first side wall), as shown in FIG. 7.

The left drum shaft bearing member 62L has a generally flat plate-like shape extending in the front-to-rear direction (precisely, in a direction parallel to the line connecting between the lower rear side and the upper front side). The left drum shaft bearing member 62L has a central portion that has a circular-shaped side view. Specifically, the left drum shaft bearing member 62L integrally includes a flange supporting portion 73 and a cleaning shaft bearing supporting portion 74.

The flange supporting portion 73 is formed on the circular-shaped central portion of the left drum shaft bearing member 62L (at a position center of the left drum shaft bearing member 62L in the front-to-rear direction). The flange supporting portion 73 includes a flange supporting hole 75 and a collar portion 76.

The flange supporting hole 75 has a circular shaped side view and is formed to penetrate through the flange supporting portion 73 in the lateral direction.

The flange supporting hole 75 has a diameter substantially identical to (slightly larger than) the outer diameter of the bearing coupled portion 55.

On a left surface of the left drum shaft bearing member 62L, the collar portion 76 is formed in a generally cylindrical shape to protrude leftward from a peripheral end portion of the flange supporting hole 75. The collar portion 76 has an outer diameter smaller than a diameter of the drum bearing supporting hole 39 formed on the left side wall 32 such that the collar portion 76 is received in the drum bearing supporting hole 39, as described earlier.

The cleaning shaft bearing supporting portion 74 is formed rearward of the flange supporting portion 73. The cleaning shaft bearing supporting portion 74 includes a cleaning shaft supporting hole 77 and a bearing engaging groove 78.

The cleaning shaft supporting hole 77 is formed in a generally oblong shape elongated in the front-to-rear direction in a side view. The cleaning shaft supporting hole 77 has, in the top-to-bottom direction, a length substantially identical to (slightly longer than) an outer diameter of the cleaning shaft receiving portion 63, whereas, in the front-to-rear direction, the cleaning shaft supporting hole 77 has a length longer than the outer diameter of the cleaning shaft receiving portion 63.

The bearing engaging groove 78 is formed at a front end portion of the cleaning shaft supporting hole 77 to be in continuous with the same, specifically, at a position generally center of the front end portion of the cleaning shaft supporting hole 77 in the top-to-bottom direction. The bearing engaging groove 78 has a generally U-shape in a left side view whose open end is oriented rearward. With respect to the top-to-bottom direction, the bearing engaging groove 78 has a width (a length) substantially identical to (slightly greater than) a length of the engaging boss 79 of the cleaning shaft bearing member 61.

Figure 8:
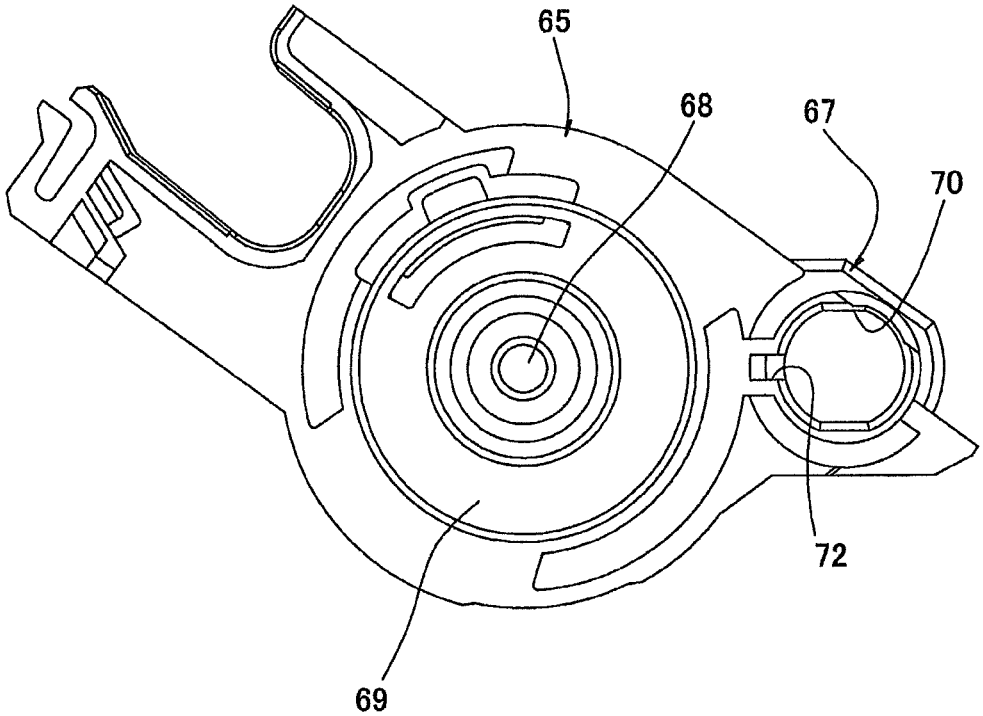
FIG. 8 is a right side view of the right drum shaft bearing member of FIG. 7.
Figure 8:
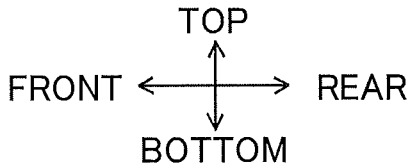

Like the left drum shaft bearing member 62L, the right drum shaft bearing member 62R has a generally flat plate-like shape extending in the front-to-rear direction (precisely, in a direction parallel to the line connecting between the lower rear side and the upper front side), as shown in FIGS. 7 and 8. The right drum shaft bearing member 62R has a center portion having a circular-shaped side view. The right drum shaft bearing member 62R integrally includes a flange supporting portion 65 and an electrode supporting portion 67.

The flange supporting portion 65 is formed at the circular-shaped center portion of the right drum shaft bearing member 62R (at a position generally center of the right drum shaft bearing member 62R in the front-to-rear direction). The flange supporting portion 65 includes a flange supporting hole 66 and a collar portion 69.

The flange supporting hole 66 is generally circular-shaped in a side view, and is formed at a position substantially center of the right drum shaft bearing member 62R in the front-to-rear direction. The flange supporting hole 66 has a diameter substantially identical to (slightly greater than) the outer diameter of the bearing coupled portion 55.

On a right surface of the right drum shaft bearing member 62R, the collar portion 69 is formed to protrude rightward from a peripheral end portion of the flange supporting hole 66. The collar portion 69 has a generally cylindrical shape whose right end is closed. The collar portion 69 has a right end wall to which a shaft 68 extending in the lateral direction is supported so as not to rotate relative to the right end wall. The shaft 68 has a central axis identical to that of the collar portion 69 (i.e., the shaft 68 is coaxially positioned relative to the collar portion 69). The collar portion 69 has an outer diameter smaller than the diameter of the drum bearing supporting hole 39 formed on the right side wall 32 such that the collar portion 69 is received in the drum bearing supporting hole 39.

The electrode supporting portion 67 is positioned rearward of the flange supporting portion 65. Referring to FIGS. 7 and 8, the electrode supporting portion 67 includes an electrode supporting hole 70, an electrode engaging groove 72 and an electrode supporting cylinder 71.

The electrode supporting hole 70 has a generally oblong shape whose cross-section is elongated in the front-to-rear direction, as shown in FIG. 8. The electrode supporting hole 70 has a length in the top-to-bottom direction substantially identical to (slightly longer than) an outer diameter of a cleaning shaft holding portion 82 (described later) of the cartridge electrode 81 (described later), whereas, in the front-to-rear direction, the electrode supporting hole 70 has a length longer than the outer diameter of the cleaning shaft holding portion 82 (described later) of the cartridge electrode 81 (described later).

The electrode engaging groove 72 is formed at a position frontward of and generally center of the electrode supporting hole 70 in the top-to-bottom direction such that the electrode engaging groove 72 is in continuous with the electrode supporting hole 70. The electrode engaging groove 72 has a generally U-shape in a right side view whose open end is oriented rearward. The electrode engaging groove 72 has a width (length) substantially identical to (slightly longer than) a length of an engaging protrusion 86 (described later) of the cartridge electrode 81 (described later) in the top-to-bottom direction.

The electrode supporting cylinder 71 is formed on a left surface of the right drum shaft bearing member 62R. The electrode supporting cylinder 71 has a generally cylindrical shape, protruding leftward from a peripheral end portion of the electrode supporting hole 70. In other words, the electrode supporting cylinder 71 and the electrode supporting hole 70 are coaxially positioned with respect to the axis A of the roller shaft 56 of the cleaning roller 51 (also see FIG. 4).

(5) Cartridge Electrode

The drum cartridge 24 includes the cartridge electrode 81 (as an example of a claimed unit electrode) configured to be electrically connected to the roller shaft 56 of the cleaning roller 51, as shown in FIG. 2.

Figure 9A:
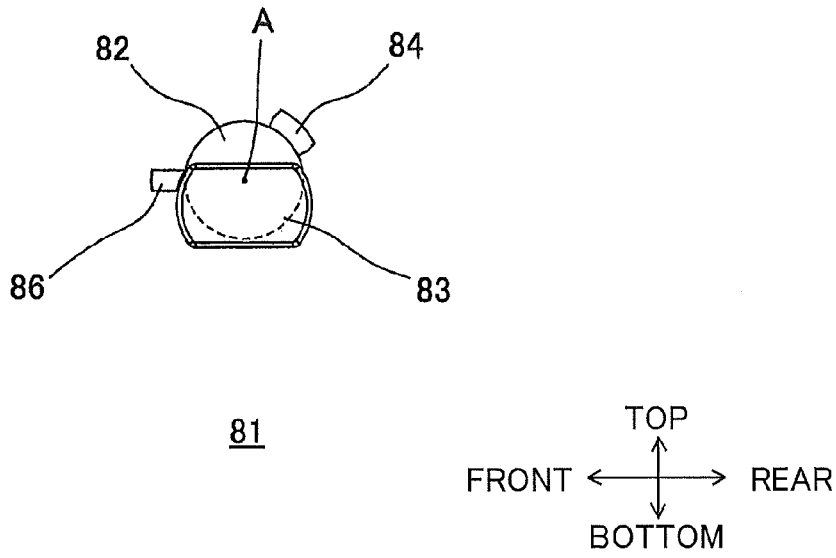
FIG. 9A is a right side view of the cartridge electrode of FIG. 2.
Figure 9B:
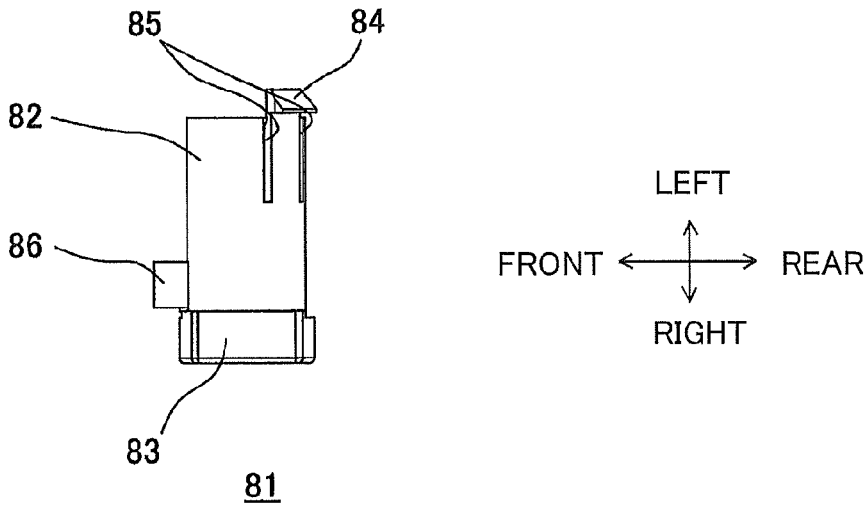
FIG. 9B is a top view of the cartridge electrode of FIG. 2.

The cartridge electrode 81 is made from an electrically conductive resin, for example, a polyacetar (POM) resin. As shown in FIGS. 9A and 9B, the cartridge electrode 81 integrally includes the cleaning shaft holding portion 82, a protruding portion 83, and an abutment portion 87 (see FIG. 4).

The cleaning shaft holding portion 82 is formed in a generally cylindrical shape extending in the lateral direction and has a right end portion that is closed (i.e, "a right end wall" is provided). As described earlier, the outer diameter of the cleaning shaft holding portion 82 is substantially identical to (slightly shorter than) the length of the electrode supporting hole 70 of the right drum shaft bearing member 62R in the top-to-bottom direction. In the front-to-rear direction, the outer diameter of the cleaning shaft holding portion 82 is shorter than the length of the electrode supporting hole 70 (see FIGS. 10A and 10B).

The cleaning shaft holding portion 82 includes an engaging claw 84 and the engaging protrusion 86.

The engaging claw 84 is provided on a left end portion the cleaning shaft holding portion 82, more specifically, at an upper-rear end portion of the left end portion of the cleaning shaft holding portion 82 (see FIG. 9A). The engaging claw 84 has a generally hook-like shape, extending first leftward from the left end portion of the cleaning shaft holding portion 82 and then bending diagonally upward and rearward. More precisely, the engaging claw 84 is positioned (interposed) between a pair of slits 85 formed on a peripheral edge of the left end portion of the cleaning shaft holding portion 82, the slits 85 extending rightward from the peripheral edge and being disposed in opposition to and in separation from each other along a circumference of the cleaning shaft holding portion 82. Due to the slits 85 interposing the peripheral edge of the left end portion of the cleaning shaft holding portion 82, the engaging claw 84, which is connected to the peripheral edge of the left end portion of the cleaning shaft holding portion 82, is resiliently deformable in the top-to-bottom direction.

The engaging protrusion 86 has a generally rectangular columnar shape, and protrudes frontward from an outer circumferential surface of the cleaning shaft holding portion 82. More precisely, the engaging protrusion 86 is formed on the outer circumferential surface of the cleaning shaft holding portion 82 at a position rightmost and frontmost thereof. In other words, the cartridge electrode 81 has a shape point-asymmetric with respect to the axis A of the cleaning roller 51, as shown in FIG. 9A.

The protruding portion 83 is generally rectangular cylindrical shaped, and extends rightward from a right end portion of the cleaning shaft holding portion 82. More specifically, the protruding portion 83 protrudes rightward from a lower-half portion of the right end portion of the cleaning shaft holding portion 82. The protruding portion 83 has a right end portion that is closed (referred to as a right end wall, hereinafter). In FIG. 9A, a plane formed when the cleaning shaft holding portion 82 is projected in the lateral direction to the right end wall of the protruding portion 83 is indicated by a broken line. As shown in FIG. 9A, a lower portion of the protruding portion 83 has portions protruding outward of the projected plane of the cleaning shaft holding portion 82 in the front-to-rear direction. Specifically, front and rear end portions of the lower portion of the protruding portion 83 protrude frontward and rearward respectively from the projected plane of the cleaning shaft holding portion 82.

The abutment portion 87 is disposed within the protruding portion 83 and the cleaning shaft holding portion 82. Specifically, as shown in FIG. 4, the abutment portion 87 is generally columnar shaped, and extends leftward from an inner surface (a left surface) of the right end wall of the protruding portion 83, as well as from an inner surface (a left surface) of the right end wall of the cleaning shaft holding portion 82.

(6) Assembly of Photosensitive Drum and Cleaning Roller

The cleaning shaft bearing member 61 is coupled to the left axial end portion of the roller shaft 56 of the cleaning roller 51 from leftward thereof such that the cleaning shaft receiving portion 63 rotatably receive therein the left axial end of the roller shaft 56, as shown in FIG. 7. At this time, the bearing coupled portion 55 of the flange member 53 provided at the left end portion of the photosensitive drum 15 is inserted into the flange penetrating hole 64 of the cleaning shaft bearing member 61 from rightward thereof. The bearing coupled portion 55 penetrates through the flange penetrating hole 64 such that the bearing coupled portion 55 is rotatable relative to the cleaning shaft bearing member 61.

The left drum shaft bearing member 62L is then assembled to the left end portion of the photosensitive drum 15 to which the cleaning shaft bearing member 61 has been coupled to. As shown in FIGS. 4 and 7, the bearing coupled portion 55 of the left flange member 53 is coupled to the flange supporting hole 75 and the collar portion 76 of the left drum shaft bearing member 62L such that the bearing coupled portion 55 is rotatable relative to the left drum shaft bearing member 62L.

At this time, the cleaning shaft receiving portion 63 of the cleaning shaft bearing member 61 is also coupled to the cleaning shaft supporting hole 77 of the left drum shaft bearing member 62L. The engaging boss 79 of the cleaning shaft bearing member 61 is also coupled to the bearing engaging groove 78 of the left drum shaft bearing member 62L.

Since the cleaning shaft supporting hole 77 has such length longer than the diameter of the cleaning shaft receiving portion 63 in the front-to-rear direction, the cleaning shaft receiving portion 63 is permitted to move in the front-to-rear direction relative to the cleaning shaft supporting hole 77. In other words, the left axial end portion of the roller shaft 56 of the cleaning roller 51 is permitted to move in the front-to-rear direction, within the cleaning shaft supporting hole 77, together with the cleaning shaft bearing member 61.

The bearing coupled portion 55 of the flange member 53 provided at the right end portion of the photosensitive drum 15 is coupled to the flange supporting hole 66 and the collar portion 69 of the right drum shaft bearing member 62R such that the bearing coupled portion 55 is rotatable relative to the right drum shaft bearing member 62R.

The cartridge electrode 81 is then coupled to the right drum shaft bearing member 62R such that the cleaning shaft holding portion 82 is held within the electrode supporting hole 70.

Specifically, the cartridge electrode 81 is coupled to the right axial end portion of the roller shaft 56 of the cleaning roller 51 from laterally rightward thereof, through the electrode supporting hole 70 of right drum shaft bearing member 62R, such that the roller shaft 56 is rotatable relative to the cleaning shaft holding portion 82. When the cleaning shaft holding portion 82 is inserted into the electrode supporting hole 70 for coupling the cartridge electrode 81 to the right drum shaft bearing member 62R, the engaging claw 84 is permitted to deform radially inward while passing through the electrode supporting cylinder 71 due to resiliency of the engaging claw 84 provided by the pair of slits 85. At this time, the abutment portion 87 of the cartridge electrode 81 is in abutment with a right peripheral edge of the right axial end portion of the roller shaft 56 from rightward thereof.

Figure 10A:
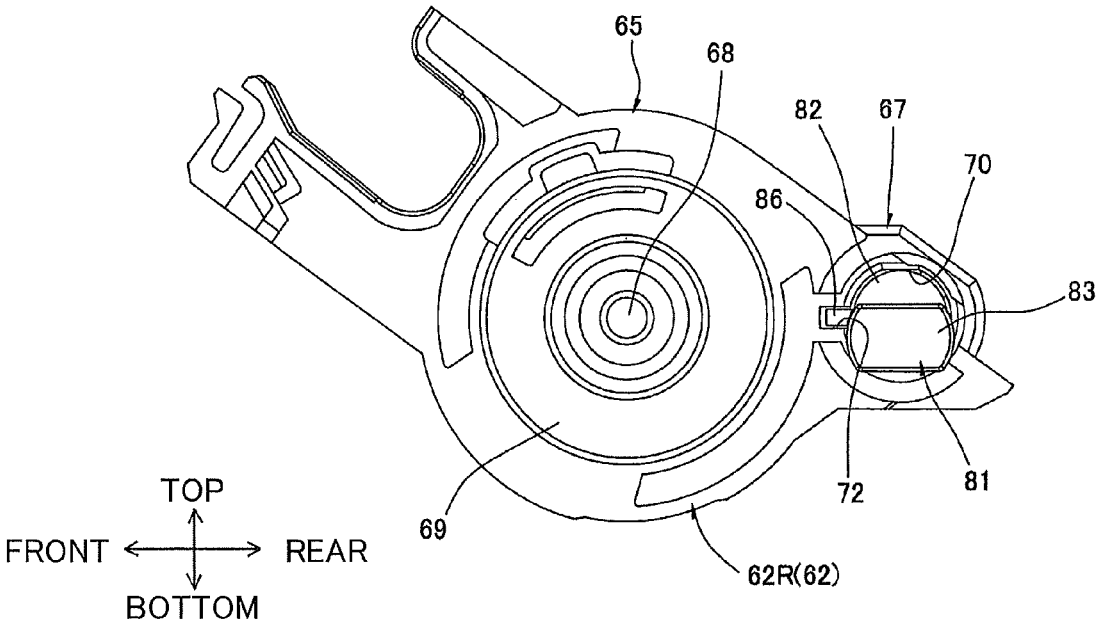
FIG. 10A is a right side view of the right drum shaft bearing member, wherein the cartridge electrode is assembled to the right drum shaft bearing member.

When the cartridge electrode 81 is coupled to the right drum shaft bearing member 62R, the engaging protrusion 86 of the cartridge electrode 81 is also coupled to the electrode engaging groove 72 (see FIG. 10A).

Figure 10B:
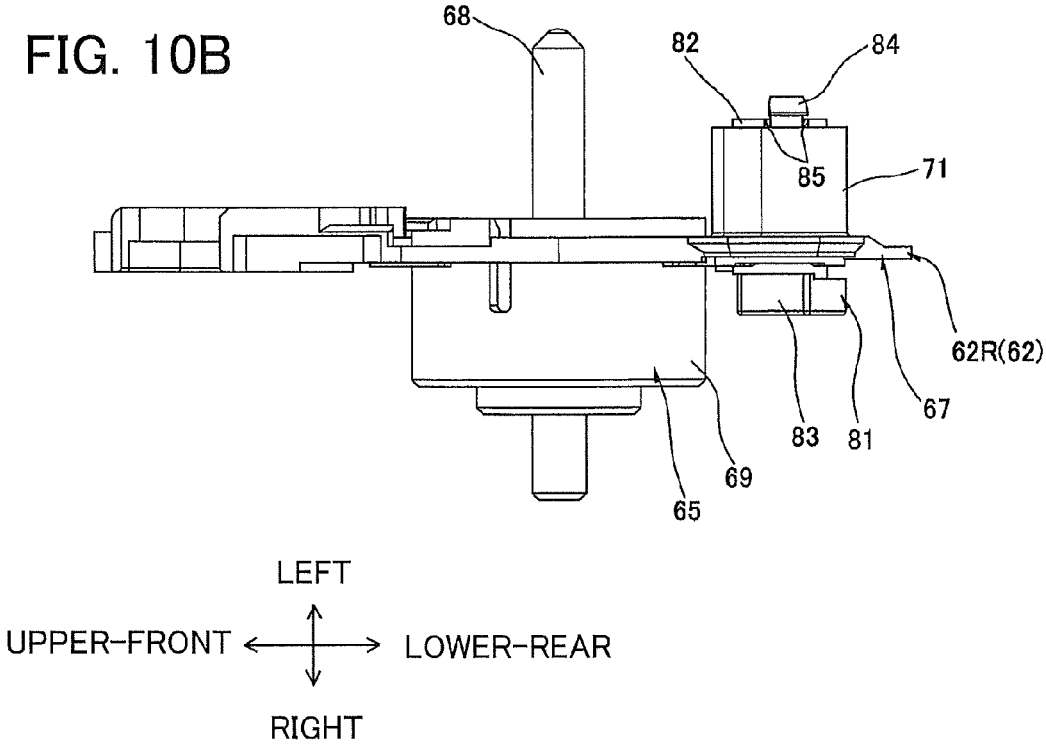
FIG. 10B is a side view of the right drum shaft bearing member of FIG. 10A when viewed from upward and rearward thereof.

At this time, as shown in FIG. 10B, the left end portion of the engaging claw 84 is positioned leftward of a left edge portion of the electrode supporting cylinder 71 of the right drum shaft bearing member 62R. The left end portion of the engaging claw 84 (the portion being bent upward and rearward) is positioned in opposition to the left edge portion of the electrode supporting cylinder 71 in the lateral direction with a gap provided therebetween.

The protruding portion 83 is positioned rightward of a right surface of the electrode supporting portion 67 of the right drum shaft bearing member 62R. As also shown in FIG. 10B, the lower portion of the protruding portion 83 (the portions protruding laterally outward of the projected plane of the cleaning shaft holding portion 82) is in opposition to and in separation from the right surface of the electrode supporting portion 67 with a small gap provided therebetween in the lateral direction.

With this structure, since the length of the electrode supporting hole 70 is larger than that of the cleaning shaft holding portion 82 in the front-to-rear direction, the cleaning shaft holding portion 82 is held within the electrode supporting hole 70 with some clearance (gap) so that the cleaning shaft holding portion 82 is movable in the front-to-rear direction by an amount of the clearance.

In other words, the cartridge electrode 81 is permitted to move in the front-to-rear direction in conjunction with movement of the cleaning roller 51 in the front-to-rear direction. The cleaning roller 51 is thus movable in the front-to-rear direction relative to the right drum shaft bearing member 62R.

Further, due to the gap formed between the left end portion of the engaging claw 84 (the portion being bent upward and rearward) and the left edge portion of the electrode supporting cylinder 71, as well as due to the gap formed between the lower portion of the protruding portion 83 (the portions protruding laterally outward of the projected plane of the cleaning shaft holding portion 82) and the right surface of the electrode supporting portion 67, the cartridge electrode 81 is also permitted to move in the lateral direction to such an extent defined by these gaps.

The pair of drum shaft bearing members 62, which rotatably supports the photosensitive drum 15 and the cleaning roller 51, is then assembled to the drum frame 31 such that the collar portion 69 of the left drum shaft bearing member 62L and the collar portion 76 of the right drum shaft bearing member 62R are respectively coupled to the drum bearing supporting holes 39 formed on both side walls 32 of the drum frame 31.

At this time, the protruding portion 83 of the cartridge electrode 81 is exposed through the electrode exposing hole 40 of the right side wall 32 such that a right end face of the protruding portion 83 protrudes slightly rightward from a right surface of the right side wall 32, as shown in FIGS. 2 and 4. In other words, the protruding portion 83 protrudes toward the right side wall 32 and further protrudes outward of the right side wall 32 in the lateral direction.

Further, the shaft abutment portion 44 of each pressing member 41 is in abutment with the roller shaft 56 of the cleaning roller 51 from rearward thereof such that the roller shaft 56 is rotatable relative to each shaft abutment portion 44. Specifically, as shown in FIGS. 4 to 6, each shaft abutment portion 44 is positioned closer to each lateral end portion of the roller main body 57 than to each axial end portion (each distal end) of the roller shaft 56 in the lateral direction.

Due to the biasing force applied from the pair of pressing members 41, the cleaning roller 51 is normally biased frontward toward the photosensitive drum 15. In other words, the cleaning roller 51 is resiliently in contact with the photosensitive drum 15 from rearward thereof.

3. Main-Body Electrode

Within the main casing 2, a main-body electrode 91 is provided at a position adjacent to and rightward of the process cartridge 11, as shown in FIG. 2.

The main-body electrode 91 is made from a material having electrical conductivity such as a metal, and formed in a spiral shape extending in the lateral direction to provide a resiliency. The main-body electrode 91 has a generally ring-shaped left end portion serving as a contact portion 92. The main-body electrode 91 is electrically connected to a power source (not shown) disposed within the main casing 2.

4. Positioning of Cleaning Roller

When the process cartridge 11 is mounted in the main casing 2, the right end face of the protruding portion 83 of the cartridge electrode 81, which protrudes from the right side wall 32 of the drum frame 31, is brought into contact with the contact portion 92 of the main-body electrode 91 from rightward thereof, as shown in FIGS. 2 and 4. In other words, the right end face of the protruding portion 83 of the cartridge electrode 81 includes (serves as) an electrical contact point or an electrical interface.

As a result, the resilient main-body electrode 91 pushes the cartridge electrode 81 leftward, thereby causing the cleaning roller 51 to move leftward integrally with the cartridge electrode 81.

The left axial end portion of the roller shaft 56 of the cleaning roller 51 is therefore pressed against an inner surface (right surface) of the left side wall 32 of the drum frame 31, via the cleaning shaft bearing member 61 and the left drum shaft bearing member 62L, thereby positioning the cleaning roller 51 with respect to the lateral direction. In other words, the rear end portion of the left side wall 32 of the drum frame 31, which the left axial end portion of the roller shaft 56 is pressed against, serves as a claimed positioning section.

5. Cleaning Operation

When the process cartridge 11 is mounted in the main casing 2, the coupling protrusions (not shown) of the coupling member (not shown) disposed in the main casing 2 are coupled to the coupling grooves 50 formed on the left flange member 53 of the photosensitive drum 15. The driving force transmitted from the driving source (not shown) disposed within the main casing 2 is thus inputted to the photosensitive drum 15.

As the photosensitive drum 15 rotates about its axis, the transmission gear 58 provided at the left end portion of the photosensitive drum 15 also rotates such that the driving force is transmitted to the cleaning roller drive gear 59. The driving force is thus transmitted to the roller shaft 56 from the cleaning roller drive gear 59, thereby enabling the cleaning roller 51 to rotate about the axis A.

At this time, the cleaning roller 51 is caused to move, slightly and resiliently, in the front-to-rear direction following rotation of the photosensitive drum 15.

When a cleaning bias is inputted from the power source (not shown) disposed within the main casing 2 to the cartridge electrode 81 via the main-body electrode 91, foreign matters adhered to the peripheral surface of the photosensitive drum 15, such as paper dusts and waste toner, are transferred to the cleaning roller 51. The peripheral surface of the photosensitive drum 15 is thus cleaned up by the cleaning roller 51.

6. Advantageous Effects (1) According to the drum cartridge 24 of the present embodiment and the printer 1 using the drum cartridge 24, as shown in FIG. 4, the cleaning roller 51 is in contact with the photosensitive drum 15 and is permitted to move in the front-to-rear direction following rotation of the photosensitive drum 15.

The cartridge electrode 81 is coupled to the roller shaft 56 of the cleaning roller 51 and is therefore integrally movable therewith in the front-to-rear direction. That is, the cartridge electrode 81 is movable following movement of the cleaning roller 51 in the front-to-rear direction.

Therefore, even when the cleaning roller 51 is caused to move in the front-to-rear direction, the cartridge electrode 81 is suppressed from slidingly moving relative to the roller shaft 56 of the cleaning roller 51. Abrasion of the cartridge electrode 81 and the roller shaft 56 of the cleaning roller 51 can therefore be suppressed, thereby realizing stable power supply to the cleaning roller 51.

Further, according to the drum cartridge 24, the right drum shaft bearing member 62R supports the cartridge electrode 81 as well as the flange member 53 provided at the right end portion of the photosensitive drum 15. Therefore, there is no need to provide a member for supporting the photosensitive drum 15 separate from a member for holding the cartridge electrode 81, thereby enabling a smaller number of parts to be required.

(2) According to the drum cartridge 24 of the present embodiment, the cartridge electrode 81 includes the cleaning shaft holding portion 82 functioning to support the cleaning roller 51 (see FIG. 4). Therefore, a member for supporting the cleaning roller 51 is not necessary to be provided separately from the cartridge electrode 81, leading to further reduction in the number of parts.

(3) According to the drum cartridge 24 of the present embodiment, the right drum shaft bearing member 62R includes the oblong electrode supporting hole 70 which is elongated in the front-to-rear direction. The cartridge electrode 81 is held within the electrode supporting hole 70 with some allowance available in the front-to-rear direction, thereby enabling the cartridge electrode 81 to reliably follow movement of the cleaning roller 51 in the front-to-rear direction.

As a result, further stable power supply to the cleaning roller 51 is realized.

(4) According to the drum cartridge 24 of the present embodiment, the cartridge electrode 81 is also movable in the lateral direction relative to the right drum shaft bearing member 62R, as shown in FIG. 10B.

With this structure, the cartridge electrode 81 can also reliably follow movement of the cleaning roller 51 in the lateral direction. Power supply to the cleaning roller 51 can be further stably performed.

(5) According to the drum cartridge 24 of the present embodiment, the protruding portion 83 of the cartridge electrode 81 protrudes rightward of the right side wall 32 of the drum frame 31 (toward a side opposite to the cleaning roller 51 with respect to the right side wall 32), as shown in FIG. 4. That is, the right end face of the protruding portion 83 is positioned rightward of the right surface of the right side wall 32 in the lateral direction.

Therefore, the main-body electrode 91 can be easily brought into contact with the right end face of the protruding portion 83 from laterally outward thereof.

(6) According to the drum cartridge 24 of the present embodiment, the cartridge electrode 81 is formed in a shape point-asymmetric about the axis A of the cleaning roller 51. Specifically, the cartridge electrode 81 has the generally rectangular columnar-shaped engaging protrusion 86 protruding frontward from the rightmost and frontmost portion of the outer circumferential surface of the cleaning shaft holding portion 82. When the cartridge electrode 81 is coupled to the electrode supporting hole 70 of the electrode supporting portion 67 of the right drum shaft bearing member 62R, the engaging protrusion 86 is received by the electrode engaging groove 72 so that the cartridge electrode 81 is incapable of rotating relative to the electrode supporting portion 67 of the right drum shaft bearing member 62R.

Due to this point-asymmetric shape, the cartridge electrode 81 is prevented from rotating about the axis A of the cleaning roller 51. As a result, power is stably inputted to the cartridge electrode 81 from the power source (not shown) disposed in the main casing 2.

(7) According to the drum cartridge 24 of the present embodiment, since the cleaning roller 51 is in contact with the photosensitive drum 15 and capable of moving following rotation of the photosensitive drum 15, the peripheral surface of the photosensitive drum 15 can be reliably cleaned by the cleaning roller 51.

(8) According to the drum cartridge 24 of the present embodiment, the cartridge electrode 81 is made from an electrically conductive resin. Therefore, forming (molding) the cartridge electrode 81 is easy.

(9) The drum cartridge 24 of the present embodiment is provided with the pair of pressing members 41 configured to press both axial end portions of the roller shaft 56 of the cleaning roller 51 toward the photosensitive drum 15, as shown in FIG. 4. Hence, the due to the pressing force of the each pressing member 41, the cleaning roller 51 can be evenly and stably in contact with the photosensitive drum 15.

More specifically, the shaft abutment portion 44 of each pressing member 41 is in abutment with (supports) the roller shaft 56 of the cleaning roller 51 to allow the roller shaft 56 to rotate relative to the shaft abutment portion 44. Further, the compression spring 43 is disposed in a compressed state between the rear wall of the pressing member accommodating portion 42 and the shaft abutment portion 44 in the front-to-rear direction, as shown in FIG. 5.

With such a simple-structure, pressing of the cleaning roller 51 toward the photosensitive drum 15 can be realized, thereby achieving stable contact between the cleaning roller 51 and the photosensitive drum 15.

(10) The shaft abutment portion 44 of each pressing member 41 is positioned between each lateral end portion of the roller main body 57 and each axial end portion of the roller shaft 56. More specifically, the shaft abutment portion 44 is arranged at a position closer to each lateral end portion of the roller main body 57 than to each axial end portion of the roller shaft 56 (or each distal end of the roller shaft 56), as shown in FIGS. 4 and 6.

In other words, the shaft abutment portion 44 of each pressing member 41 is in abutment with (or rotatably supports) the roller shaft 56 of the cleaning roller 51 at a position closer to the roller main body 57. Hence, the roller main body 57 of the cleaning roller 51 can be further reliably pressed against the photosensitive drum 15.

(11) According to the drum cartridge 24 of the present embodiment, the main-body electrode 91 is resiliently in contact with the cartridge electrode 81 from rightward thereof, thereby positioning the cartridge electrode 81 and the cleaning roller 51 relative to the left side wall 32 of the drum frame 31 in the lateral direction.

With this structure, the main-body electrode 91 can be reliably in contact with the cartridge electrode 81, while the cartridge electrode 81 and the cleaning roller 51 can be positioned relative to the drum frame 31.

7. Variations and Modifications

In the above-described embodiment, the flange member 53 on the right side of the photosensitive drum 15 is supported to the right side wall 32 via the right drum shaft bearing member 62R, while the flange member 53 on the left side of the photosensitive drum 15 is supported to the left side wall 32 via the left drum shaft bearing member 62L.

However, both bearing members may be dispensed with. That is, the right flange member 53 may be directly supported to the right side wall 32 without the right drum shaft bearing member 62R. Likewise, the left flange member 53 may be directly supported to the left side wall 32 without the left drum shaft bearing member 62L.

In the depicted embodiment, the cleaning roller 51 is employed as an example of the claimed rotatable body, and a bias is applied, through the cartridge electrode 81, to the cleaning roller 51 that is in contact with the photosensitive drum 15.

This construction can also be applied to another rotatable body (for example, a transfer roller, a charging roller and a developing roller) that is disposed in contact with a photosensitive drum and applied with a bias from a main body.

Further, in the embodiment, the electrode supporting hole 70 is formed as an oblong-shaped hole elongated in the front-to-rear direction. However, the shape of the electrode supporting hole 70 may not necessarily be limited to this shape nor any specific shape, provided that the cartridge electrode 81 is movable in the front-to-rear direction when coupled to the electrode supporting hole 70. For example, the electrode supporting hole 70 may be formed in a generally circular shape whose a diameter is longer than the length of the cartridge electrode 81 in the front-to-rear direction.

While the invention has been described in detail with reference to the embodiments thereof, it would be apparent to those skilled in the art that various changes and modifications may be made therein without departing from the spirit of the invention.

What is claimed is:

1. A photosensitive member unit comprising:

a photosensitive member defining an axis extending in an axial direction and configured to rotate about the axis, the photosensitive member having a first end portion and a second end portion opposite to the first end portion in the axial direction;

a first side wall configured to rotatably support the first end portion of the photosensitive member;

a second side wall disposed in opposition to the first side wall in the axial direction and configured to rotatably support the second end portion of the photosensitive member;

a rotatable body extending in the axial direction and rotatably disposed between the first side wall and the second side wall, the rotatable body being in confrontation with and in contact with the photosensitive member in a prescribed direction perpendicular to the axial direction, the rotatable body being movable in the prescribed direction;

a unit electrode provided at the first side wall, the unit electrode supporting and being in contact with the rotatable body for supplying electricity to the rotatable body, the first side wall supporting the unit electrode such that the unit electrode is movable in the prescribed direction in conjunction with movement of the rotatable body in the prescribed direction; and a third side wall disposed at a side opposite to the rotatable body with respect to the first side wall, wherein the unit electrode comprises a protruding portion protruding toward the third side wall and further protruding outward of the third side wall in the axial direction, the protruding portion serving as an electrical interface configured to receive electricity supplied thereto.

2. The photosensitive member unit according to claim 1, wherein the unit electrode comprises a supporting portion configured to rotatably support the rotatable body.

3. The photosensitive member unit according to claim 1, wherein the first side wall comprises an electrode supporting portion configured to support the unit electrode, the unit electrode supporting portion being formed with an elongated hole which penetrates therethrough in the axial direction and whose cross-sectional shape is elongated in the prescribed direction.

4. The photosensitive member unit according to claim 1, wherein the unit electrode is further configured to be movable in the axial direction relative to the first side wall.

5. The photosensitive member unit according to claim 1, wherein the rotatable body defines a rotational axis about which the rotatable body is rotatable, and wherein the unit electrode is formed in a shape point-asymmetric with respect to the rotational axis of the rotatable body.

6. The photosensitive member unit according to claim 1, wherein the rotatable body is a cleaning roller configured to clean up a peripheral surface of the photosensitive member.

7. The photosensitive member unit according to claim 1, wherein the unit electrode is made from an electrically conductive resin.

8. The photosensitive member unit according to claim 1, further comprising a pressing portion configured to press the rotatable body toward the photosensitive member in the prescribed direction.

9. The photosensitive member unit according to claim 8, wherein the third wall supports the first side wall, the photosensitive member unit further comprising:

a fourth side wall supporting the second side wall and disposed in opposition to the third side wall in the axial direction; and a fifth side wall extending in the axial direction and connecting between the third side wall and the fourth side wall, wherein the pressing portion is provided at the fifth side wall.

10. The photosensitive member unit according to claim 9, wherein the rotatable body comprises:

a rotational shaft extending in the axial direction, the rotational shaft having axial end portions opposite to each other in the axial direction and a remaining portion other than the axial end portions; and a cover portion covering the remaining portion of the rotational shaft; and, wherein the pressing portion comprises:

an abutment portion disposed in opposition to the fifth side wall in the prescribed direction and configured to be in abutment with each axial end portion of the rotational shaft in the prescribed direction; and a biasing member disposed between the abutment portion and the fifth side wall in the prescribed direction in a compressed state.

11. The photosensitive member unit according to claim 10, wherein:

the cover portion has end portions opposite to each other in the axial direction, each axial end portion has a distal end, and the abutment portion is positioned between each distal end and each end portion of the cover portion such that the abutment portion is positioned closer to the end portion of the cover portion than to the distal end.

12. An image forming apparatus comprising:

a main casing;

a photosensitive member unit detachably mountable in the main casing, the photosensitive member unit including:

a photosensitive member defining an axis extending in an axial direction and configured to rotate about the axis, the photosensitive member having a first end portion and a second end portion opposite to the first end portion in the axial direction;

a first side wall configured to rotatably support the first end portion of the photosensitive member;

a second side wall disposed in opposition to the first side wall in the axial direction and configured to rotatably support the second end portion of the photosensitive member;

a rotatable body extending in the axial direction and rotatably disposed between the first side wall and the second side wall, the rotatable body being in confrontation with and in contact with the photosensitive member in a prescribed direction perpendicular to the axial direction, the rotatable body being movable in the prescribed direction; and a unit electrode provided at the first side wall and in contact with the rotatable body for supplying electricity to the rotatable body, the first side wall supporting the unit electrode such that the unit electrode is movable in the prescribed direction in conjunction with movement of the rotatable body in the prescribed direction; and a third side wall supporting the second side wall at a side opposite to the rotatable body with respect to the second side wall, the third side wall having a positioning section; and a main-body electrode disposed within the main casing for supplying electricity to the unit electrode, and configured to resiliently contact the unit electrode in the axial direction, the unit electrode being biased toward the third side wall due to resilient contact of the main-body electrode such that the rotatable body is biased toward the positioning section of the third side wall integrally with the unit electrode for positioning the rotatable body relative to the third side wall.

13. A photosensitive member unit comprising:

a photosensitive member defining an axis extending in an axial direction and configured to rotate about the axis, the photosensitive member having a first end portion and a second end portion opposite to the first end portion in the axial direction;

a first side wall configured to rotatably support the first end portion of the photosensitive member;

a second side wall disposed in opposition to the first side wall in the axial direction and configured to rotatably support the second end portion of the photosensitive member;

a rotatable body extending in the axial direction and rotatably disposed between the first side wall and the second side wall, the rotatable body being in confrontation with and in contact with the photosensitive member in a prescribed direction perpendicular to the axial direction, the rotatable body being movable in the prescribed direction, the rotatable body comprising a rotational shaft extending in the axial direction, the rotational shaft having axial end portions opposite to each other in the axial direction and a remaining portion other than the axial end portions; and a cover portion covering the remaining portion of the rotational shaft;

a unit electrode provided at the first side wall, the unit electrode supporting and being in contact with the rotatable body for supplying electricity to the rotatable body, the first side wall supporting the unit electrode such that the unit electrode is movable in the prescribed direction in conjunction with movement of the rotatable body in the prescribed direction;

a pressing portion configured to press the rotatable body toward the photosensitive member in the prescribed direction;

a third side wall supporting the first side wall;

a fourth side wall supporting the second side wall and disposed in opposition to the third side wall in the axial direction; and a fifth side wall extending in the axial direction and connecting between the third side wall and the fourth side wall, wherein the pressing portion is provided at the fifth side wall and comprises:

an abutment portion disposed in opposition to the fifth side wall in the prescribed direction and configured to be in abutment with each axial end portion of the rotational shaft in the prescribed direction; and a biasing member disposed between the abutment portion and the fifth side wall in the prescribed direction in a compressed state.

14. The photosensitive member unit according to claim 13, wherein:

the cover portion has end portions opposite to each other in the axial direction, each axial end portion has a distal end, and the abutment portion is positioned between each distal end and each end portion of the cover portion such that the abutment portion is positioned closer to the end portion of the cover portion than to the distal end.

15. The photosensitive member unit according to claim 13, wherein the unit electrode comprises a supporting portion configured to rotatably support the rotatable body.

16. The photosensitive member unit according to claim 13, wherein the first side wall comprises an electrode supporting portion configured to support the unit electrode, the unit electrode supporting portion being formed with an elongated hole which penetrates therethrough in the axial direction and whose cross-sectional shape is elongated in the prescribed direction.

17. The photosensitive member unit according to claim 13, wherein the unit electrode is further configured to be movable in the axial direction relative to the first side wall.

18. The photosensitive member unit according to claim 13, wherein the rotatable body defines a rotational axis about which the rotatable body is rotatable, and wherein the unit electrode is formed in a shape point-asymmetric with respect to the rotational axis of the rotatable body.

19. The photosensitive member unit according to claim 13, wherein the rotatable body is a cleaning roller configured to clean up a peripheral surface of the photosensitive member.

20. The photosensitive member unit according to claim 13, wherein the unit electrode is made from an electrically conductive resin.

* * * * *